US010900749B2

(12) United States Patent
Tello

(10) Patent No.: US 10,900,749 B2
(45) Date of Patent: Jan. 26, 2021

(54) UNIVERSAL FIREARM MARKSMANSHIP SYSTEM

(71) Applicant: Selso Tello, College Park, GA (US)

(72) Inventor: Selso Tello, College Park, GA (US)

( * ) Notice: Subject to any disclaimer, the term of this patent is extended or adjusted under 35 U.S.C. 154(b) by 244 days.

(21) Appl. No.: 16/209,772

(22) Filed: Dec. 4, 2018

(65) Prior Publication Data

US 2019/0093987 A1 Mar. 28, 2019

Related U.S. Application Data

(63) Continuation of application No. 15/147,601, filed on May 5, 2016, now Pat. No. 10,145,653, which is a continuation of application No. 13/928,153, filed on Jun. 26, 2013, now Pat. No. 9,335,125.

(60) Provisional application No. 61/664,460, filed on Jun. 26, 2012.

(51) Int. Cl.
*F41G 3/26* (2006.01)
*F41G 3/32* (2006.01)

(52) U.S. Cl.
CPC ..... *F41G 3/2644* (2013.01); *F41G 3/2633* (2013.01); *F41G 3/323* (2013.01)

(58) Field of Classification Search
CPC ..... F41A 33/00; F41A 33/02; F41A 33/04; F41A 33/06; F41G 3/26; F41G 3/2633; F41G 3/2644; F41G 3/323
See application file for complete search history.

(56) References Cited

U.S. PATENT DOCUMENTS 3,743,818 A 7/1973 Marasco et al.
3,782,832 A 1/1974 Hacskaylo
4,336,018 A 6/1982 Marshall et al.
4,531,052 A 7/1985 Moore
4,640,514 A 2/1987 Myllyla et al.
4,955,812 A 9/1990 Hill
(Continued)

FOREIGN PATENT DOCUMENTS

EP 1398595 A1 3/2004

OTHER PUBLICATIONS

Anderson, Gary, "Safety Indicator Adopted for Air Rifles," CMP On-Line Magazine, http://www.odcmp.org/0405/default.asp?page=CBI, website accessed Mar. 8, 2018, predates Oct. 30, 2017, 4 pages.

(Continued)

*Primary Examiner* — Timothy A Musselman
(74) *Attorney, Agent, or Firm* — Schacht Law Office, Inc.; Dwayne Rogge

(57) ABSTRACT

A universal marksmanship training system is disclosed herein configured to utilize a display device comprising a graphic display. A software application may also be provided. The software application is often configured to display a virtual target on the graphic display. A chamber insert may be utilized, the chamber insert configured to be positioned with the firing chamber of a firearm to be zeroed, wherein the chamber insert interacts with the software application to determine alignment of a bore of the firearm to a bore alignment point on the graphic display. In one form, the display device displays a sight target on the graphic display wherein the sight target is visually perceived by a marksman, and is offset from the bore alignment point by a offset distance. In one form, the software application calculates the sight target relative to the bore alignment point of the firearm given a set of condition variables.

5 Claims, 15 Drawing Sheets

(56) References Cited

U.S. PATENT DOCUMENTS

| | | | |
|---|---|---|---|
| 5,187,744 | A | 2/1993 | Richter |
| 5,305,381 | A | 4/1994 | Wang et al. |
| 5,454,168 | A | 10/1995 | Langner |
| 5,787,631 | A | 8/1998 | Kendall |
| 6,322,365 | B1 | 11/2001 | Shechter et al. |
| 6,516,699 | B2 | 2/2003 | Sammut et al. |
| 6,572,375 | B2 | 6/2003 | Shechter et al. |
| 6,575,753 | B2 | 6/2003 | Rosa et al. |
| 7,329,127 | B2 | 2/2008 | Kendir et al. |
| 9,335,125 | B2 | 5/2016 | Tello |
| 10,145,653 | B2 | 12/2018 | Tello |
| 2002/0002788 | A1 | 1/2002 | Hope |
| 2006/0231714 | A1 | 10/2006 | Crain et al. |
| 2007/0137090 | A1 | 6/2007 | Conescu |
| 2010/0092925 | A1 | 4/2010 | Lvovskiy et al. |
| 2011/0207089 | A1 | 8/2011 | Lagettie et al. |
| 2012/0106170 | A1 | 5/2012 | Matthews et al. |
| 2012/0129136 | A1 | 5/2012 | Dvorak |

OTHER PUBLICATIONS

Hornady, "Hornady (Formerly Stoney Point Overall Length Gauge (Curved)," https://www.dillonprecision.com/hornady-formerly-stoney-point-verall- . . . , website accessed Mar. 8, 2018; predates Oct. 30, 2017, 5 pages.

Hornady, "Hornady-Rapid Rack," https://www.brownells.com/shooting-accessories/training-safety-gear/c . . . , website accessed Mar. 8, 2018, predates Oct. 30, 2017, 2 pages.

International Searching Authority, International Search Report, PCT/US2013/047964, dated Nov. 14, 2013, 2 pages.

UNIVERSAL FIREARM MARKSMANSHIP SYSTEM

RELATED APPLICATIONS

This application claims priority benefit of and is a continuation of Ser. No. 15/147,601 filed on May 5, 2016, which claims priority benefit of and is a continuation of U.S. Ser. No. 13/928,153 filed on Jun. 26, 2013, now U.S. Pat. No. 9,335,125 issued on May 10, 2016, which in turn claims priority benefit of U.S. Ser. No. 61/664,460 filed Jun. 26, 2012, each of these incorporated by reference.

BACKGROUND OF THE DISCLOSURE

Field of the Disclosure

This disclosure relates to the field of marksmanship systems wherein a marksman will zero a live round firearm at a first location, and then apply a virtual sighting/targeting system which simulates the location and conditions of a live fire shooting location. Other aspects of the disclosure relate to simulated shooting of a firearm.

SUMMARY OF THE DISCLOSURE

Several examples of a universal marksmanship training system (UMTS) are disclosed herein. One example comprising a display device including a graphic display which may be a handheld style device. A software display application (Display App) may also be provided. The Display App in at least one example configured to display a virtual target on the graphic display. A chamber insert may also be utilized. Such a chamber insert is configured to be positioned within the chamber of a firearm to be zeroed, wherein the chamber insert interacts with the Display App to determine alignment of a bore of the firearm to a bore alignment point on the graphic display. Such chamber inserts generally have the same outer diameter and length as a life-fire round, so as to replace a life-fire round in simulated or targeting applications. In one form of the disclosed device and system, the display device displays a sight target on the graphic display wherein the sight target is visually perceived by a marksman, and the sight target is vertically offset from the bore alignment point by an offset distance which takes into account the offset horizontal position from the sight target to a non-simulated target. In one form, the Display App calculates the sight target relative to the bore alignment point of the firearm given a set of condition variables.

The training system as disclosed may be arranged wherein the virtual target is representative of a non-simulated target.

The training system is arranged in one form wherein the condition variables accounted for in sighting or simulated shooting of the firearm are selected from the list consisting of: elevation of the real life target; weather conditions expected at the real-life target; and ballistic characteristics of the firearm; ballistics characteristics of the cartridge to be fired; expected distance to the target; and marksman firing offset.

The training system is described in one form as further comprising a display device support arm. The support arm in one example including: a first end attached to a barrel end of the firearm; and a second end comprising a display device attachment bracket.

The training system is disclosed in one form is arranged wherein the support arm is positionable so as to align the display device relative to the bore of the firearm.

The training system is disclosed in one form as comprising iron sights, an optical sight, and/or a red dot sight.

The training system as disclosed above may be arranged wherein the chamber insert comprises a laser beam emitting device. The training system may utilize a magazine having a power supply electrically coupled to the chamber insert. The magazine may otherwise resemble a standard magazine for containment and firing of a set of cartridges. In one form, the power supply comprises a battery.

The training system is disclosed in one form is arranged wherein the vertical offset distance is substantially equal to the vertical offset between the alignment point (line) of the sight and the center (line) of the firearm bore at the sight.

DESCRIPTION OF THE PREFERRED EMBODIMENTS

The Universal Marksmanship Training System (UMTS) as disclosed herein utilizes existing technology and allows for future improvements. Currently, the US armed services are deploying training simulations systems and devices that instruct personnel on vehicle driving, weapons marksmanship, combat tactics techniques and procedures (TTPs) from small unit to large fighting formations. Such systems are designed for use with and by the armed services. These systems may be modular or may stand alone, and may have the capability to be connected to and interact with a larger network of training and/or tactical components. It is desired in such systems that marksmen utilizing their own firearms 28 before and after sighting (zeroing) their firearm 28 learn the significance of their training in marksmanship experience, maintenance, and clearing malfunctions.

Figure 1:
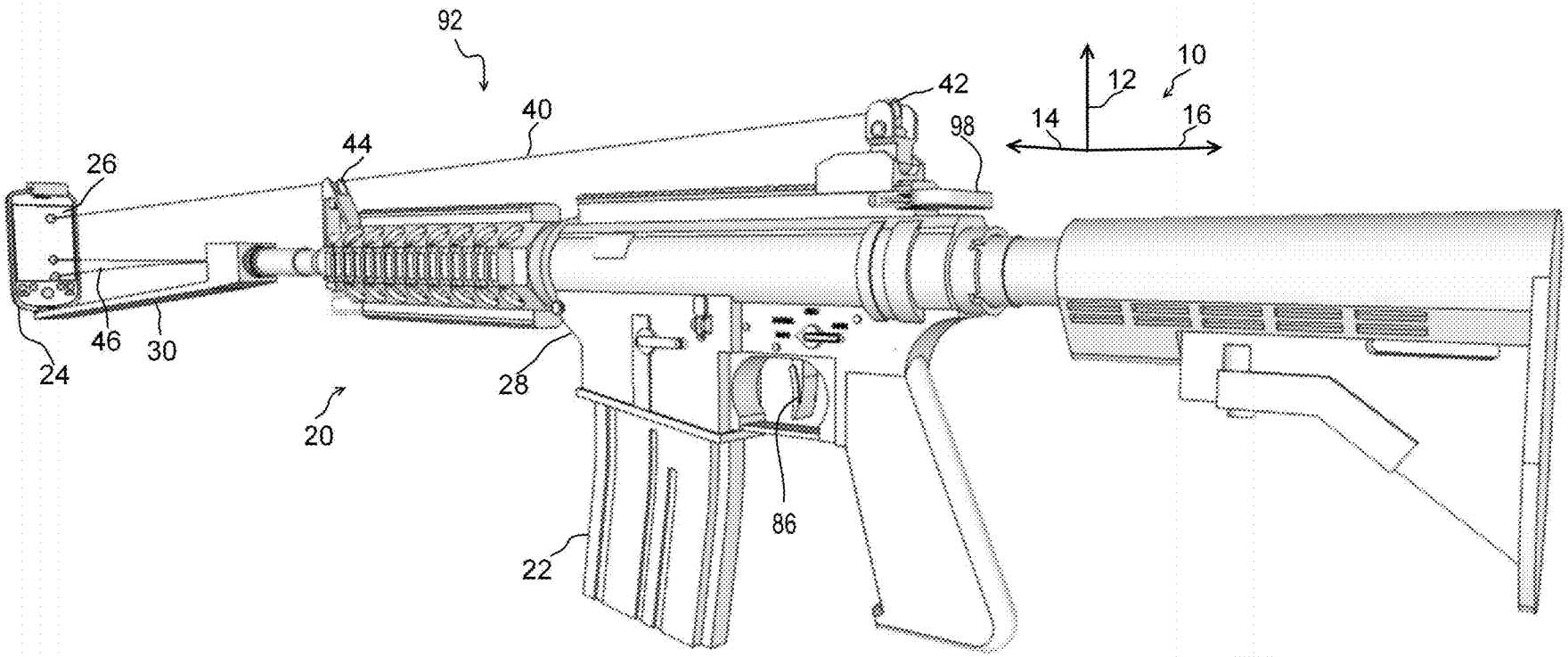
FIG. 1 is a perspective view of one example of the disclosure.

Before beginning a detailed description of the novel examples disclosed herein, an axes system 10 is disclosed for ease in understanding of the examples presented. The axes system 10 as shown in FIG. 1 generally comprises a vertical axis 12, a transverse axis 14, and a longitudinal axis 16. The longitudinal axis 16 is aligned with the bore of the firearm. The vertical axis 12 and transverse axis 14 are orthogonal to both other axes. While the term vertical is used to describe the axis 12, as the firearm 28 and other components are moveable/positionable, the vertical direction is in relation to the axes 12, 14 and 16 and is not intended to limit the firearm 28 or UMTS to a particular orientation relative to Earth or any other outside element.

The term "zero" is used herein as a version of "to adjust (an instrument or apparatus) to a zero point or to an arbitrary reading from which all other readings are to be measured." In particular, the term is used to denote a condition wherein a marksman (user) has aligned the sights 92 of a firearm 28 with the impact point (live fire or calculated) of a projectile fired from the firearm 28 under specific conditions. Subsequent alignment of the sights 92 of the firearm 28 will result in a projectile fired from that firearm impacting a target at a desired location under real-life conditions. Such conditions may include distance 94 to target (FIG. 12), elevation differential from shooter to target, elevation of range above sea level, temperature, etc.

When firing a non-zeroed firearm 28 at a target 104 (see FIG. 12), a marksman fires the firearm 28 and the projectile 106 strikes the target 104, the point of aim 38 (where the marksman has aligned the sights 92) and the point of impact (where the round strikes the target) do not often coincide. The conditions or variables that result in the discrepancy will be accounted for by the marksman by adjusting the sights 92 of the firearm 28, to offset the discrepancy. The marksman will adjust the sights 92 (point of aim 38) up, down, left, or right until the discrepancy (if any) is within an acceptable standard of accuracy in relationship to the point of impact on the target 104 (zeroing the firearm 28 to that distance). If the marksman can virtually isolate a variable(s) resulting in the discrepancy, and extract the variable(s) from the whole, and if a new variable(s) are accounted for without firing of a projectile 106, then a new sight alignment can be achieved in a virtual scenario representative of a real-life set of conditions and target 104 and the need to fire many expensive and dangerous rounds of ammunition through the firearm 28 to establish a correct sight alignment may be avoided. This virtual system reduces wear on the firearm 28 and cost of ammunition.

Software. The disclosed Universal Marksmanship Training System (UMTS) 20 in one form includes a Display Application (App) specifically written for firearm (generally provided as a rifle) marksmanship in conjunction with the system/hardware disclosed herein. A marksman can also provide data to the Display App from a portable weather station, a Global Positioning System, a muzzle velocity measuring device, keyboard, touch pad, database, or other system. The Display App in one form may comprise firearm and bullet (projectile and cartridge) ballistics firing data which are commonly found in ballistic tables. The inputs from chronographs, GPS trackers, portable weather station, and others sources can be incorporated. This UMTS in one example will incorporate several interoperating components in a small easy to carry case.

Figure 9:
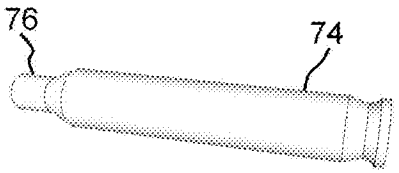
FIG. 9 is a perspective view of one example of a cartridge insert.

Hardware. The hardware portions of the system 20 may comprise a chamber insert 74, which may be designed to fit a firearm of a particular caliber. One such chamber insert 74 is disclosed in U.S. Pat. No. 5,787,631 incorporated herein by reference for the technical details and supported disclosed therein. One Example of such a chamber insert 74 is shown in FIG. 9 of the current disclosure. Such a chamber insert 74 will center in the bore of the firearm 28 and may project an emission beam 36 down the bore of the firearm in the path a live round projectile would normally traverse. In another example, the cartridge insert 74 may house a proximity sensor that interacts with visual data displayed on (and thus emitting from) a graphic display 26. The insert 74 in one example is formed to center in the bore 84 of the firearm 28 each and every time it is used properly. One such bore mounted insert 134 is shown in FIG. 20 comprising a sensor mount 136.

Figure 20:
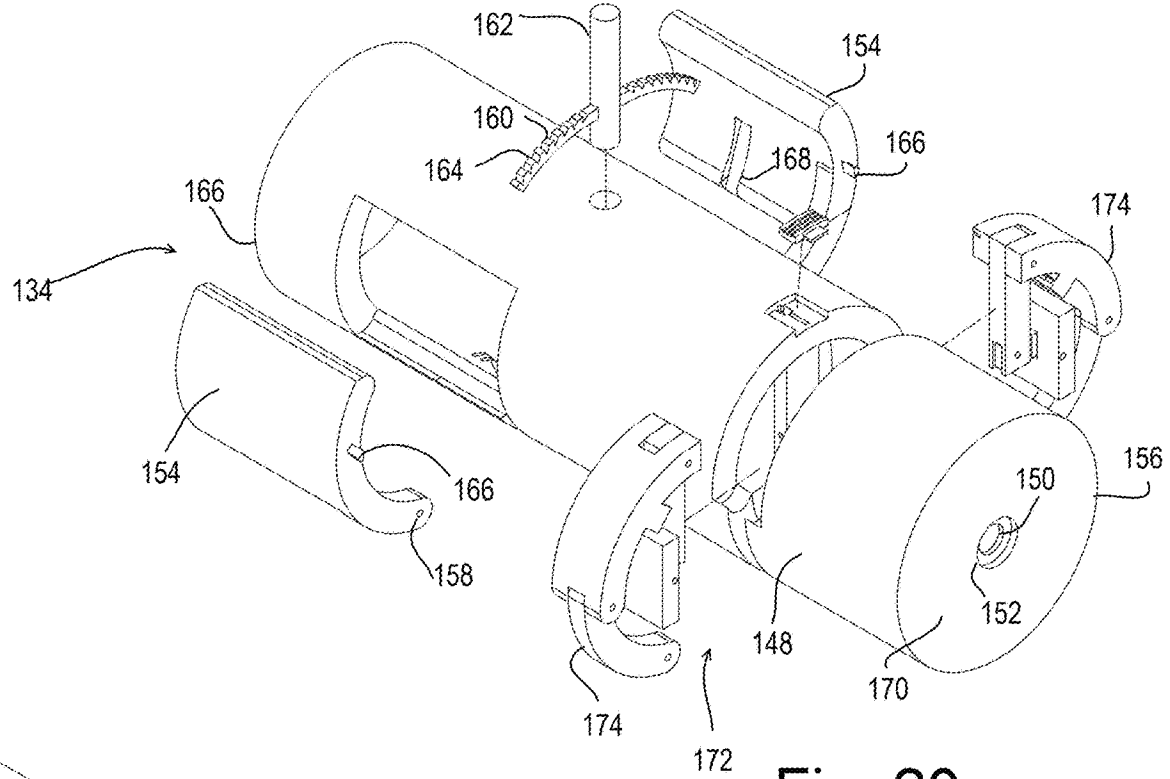
FIG. 20 is a front isometric exploded view of one example of a display device and sensor mounting structure.
Figure 21:
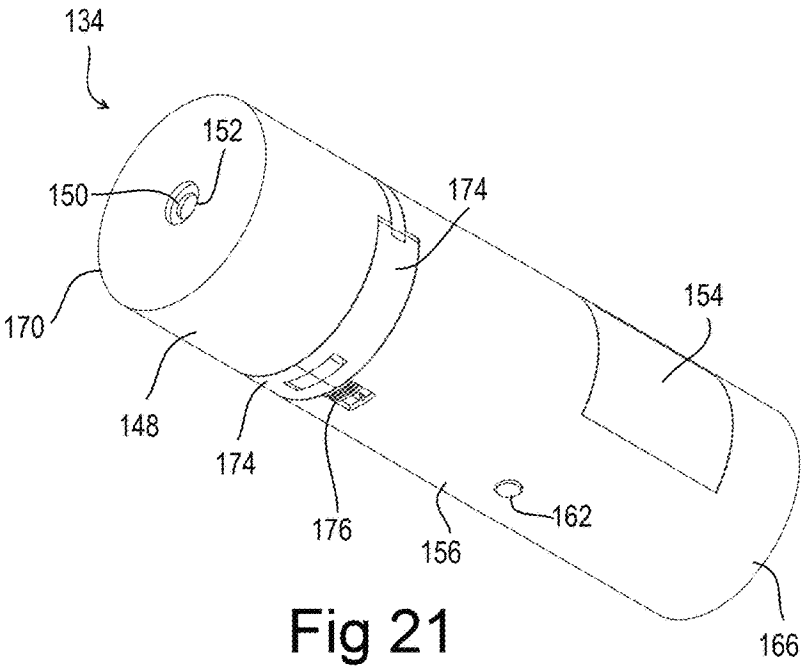
FIG. 21 is a front isometric assembled view of the device shown in FIG. 20.
Figure 24:
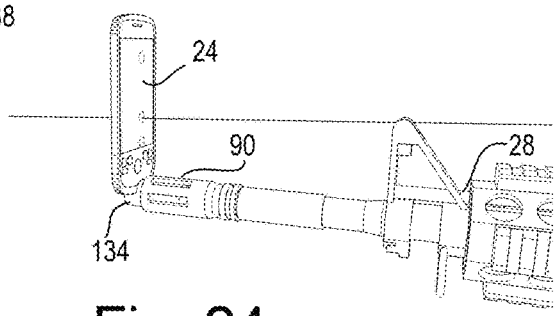
FIG. 24 is a side isometric view of the device shown in FIG. 20 attached to the barrel of a firearm.

In FIGS. 20, 21, and 24 the bore mounted insert 134 has a cylindrical outer surface 148 smaller than the inner surface of the barrel 90, flame suppressor, flash suppressor, etc. In the example shown, a through hole 150 is provided centered on the outer surface 148 so that an emission beam 36 may transit the insert 134 substantially unhindered. Alternatively, a sensor 78 may be attached at a sensor mount 152 and aligned with the through hole 152. The sensor 78 in such an example would detect an emission beam from an emitter 76.

This example of a bore mounted insert 134 utilizes a plurality of ratchet action rifle grip arms 154 which may be pivotally coupled to the main cylindrical body 156 by way of pivots 158. A ratchet mechanism is provided including a ratchet arm 160 within the main body 156. A button ratchet grip arm release 162 may engage the ratchet arm 160 and reposition teeth 164 away from pins 166 to release the ratchet mechanism. To attach the insert 134 to the barrel 90 of a firearm or other surface, the arms 154 are withdrawn and the first end 166 of the device is inserted into the barrel 90. When the button 162 is actuated (depressed), springs 168 bias the arms 154 outward to grip the inner surface of the barrel 90. The insert 134 may be rotated by substantial rotational force, or withdrawn by substantial longitudinal force.

At the second end 170, a display device clamp/adapter 172 may be provided. In the example shown, a plurality of folding arms 174 are released by a deploy release 176. The arms 174 and slot formed in the main body 156 cooperate to hold the display device 24 in position as shown in FIG. 24 such that the display screen can be viewed through the firearm sights. A sight target and/or simulated environment or grid may be displayed on the display screen.

In one example, the display device 24 is coupled to the sensor 78. In this way, when the sensor 78 is activated via actuation of the firearm trigger, the display device detects such trigger actuation and may alter the display projected to the user. Such coupling may be a wired or wireless coupling.

In one form, a detection portion (camera) of the display device projects into the center bore of the insert 134 and is so aligned to directly detect actuation of the trigger via a chamber insert 74 or equivalent.

Figure 13:
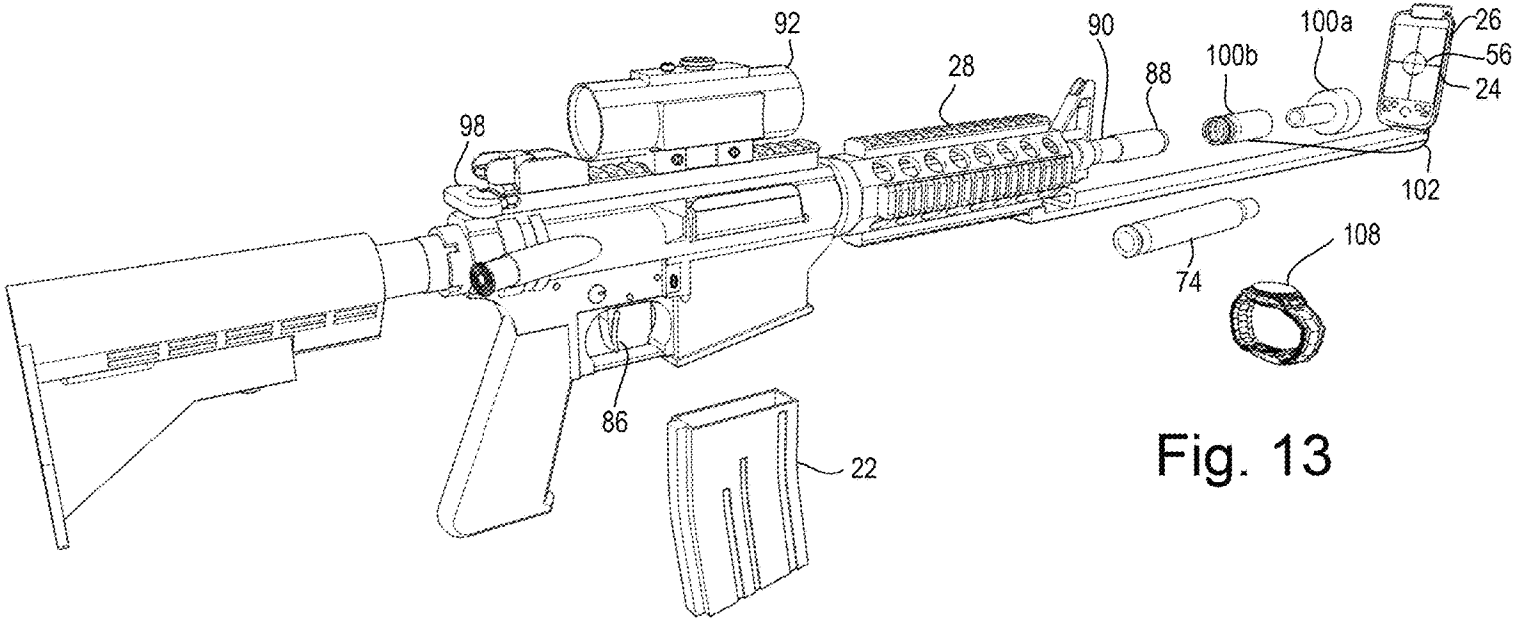
FIG. 13 is a side isometric view of another example of the disclosed apparatus which may utilize a remote control device and other components.

In one form, a cartridge magazine 22 as shown in FIG. 1 may include an insert which in turn may comprise a battery or equivalent power storing device to power the chamber insert 74. In addition, a laser or infrared sensors 100*a* and 100*b* of FIG. 13 may be utilized in combination and powered by the power storing device. The battery may also provide power to a recoil mechanism that generates a recoil sensation each and every time the marksman actuates the trigger 86 to more accurately simulate life fire shooting. For a self-reloading (automatic or semi-automatic) firearm, a trigger resetting mechanism may be provided. A muzzle velocity chronograph may also be incorporated to measure muzzle velocity of a projectile 106 fired from the firearm 28. This muzzle velocity data may be recorded by the system or peripherals for analysis. The chronograph may be initially set (adjusted) indoors with a method to fire the projectiles 106 safely such as that disclosed in U.S. Pat. No. 4,030,097.

The hardware components of the system 20 may also include a display device 24 having a graphic display 26 (display screen) thereon. While the display device 24 is shown as a cell phone; tablet computers, laptop computer, or other portable devices may be used. In one form as shown in FIG. 1, the display device 24 is attached to a firearm 28 through a positionable arm 30 with a bracket 62 thereon. In other examples such as shown in FIG. 24, the display device 24 is attached via a bore mounted insert 134.

Figure 2:
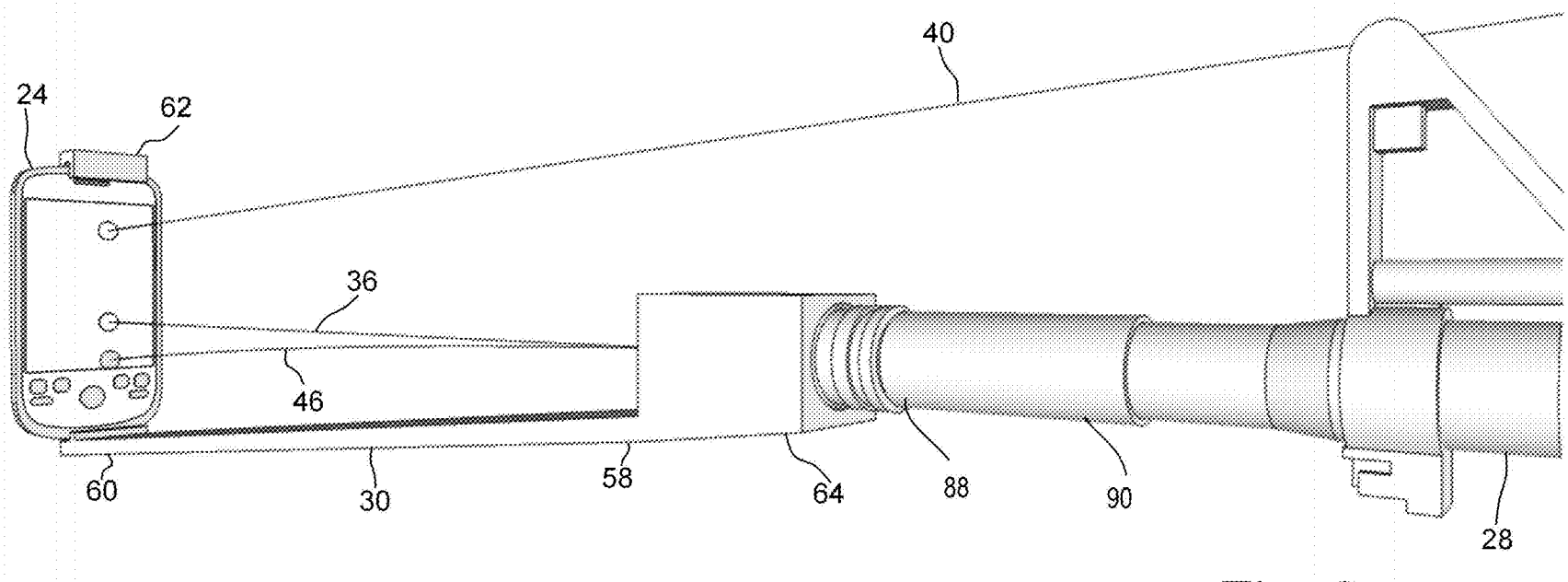
FIG. 2 is a perspective enlarged view of one region of FIG. 1.
Figure 3:
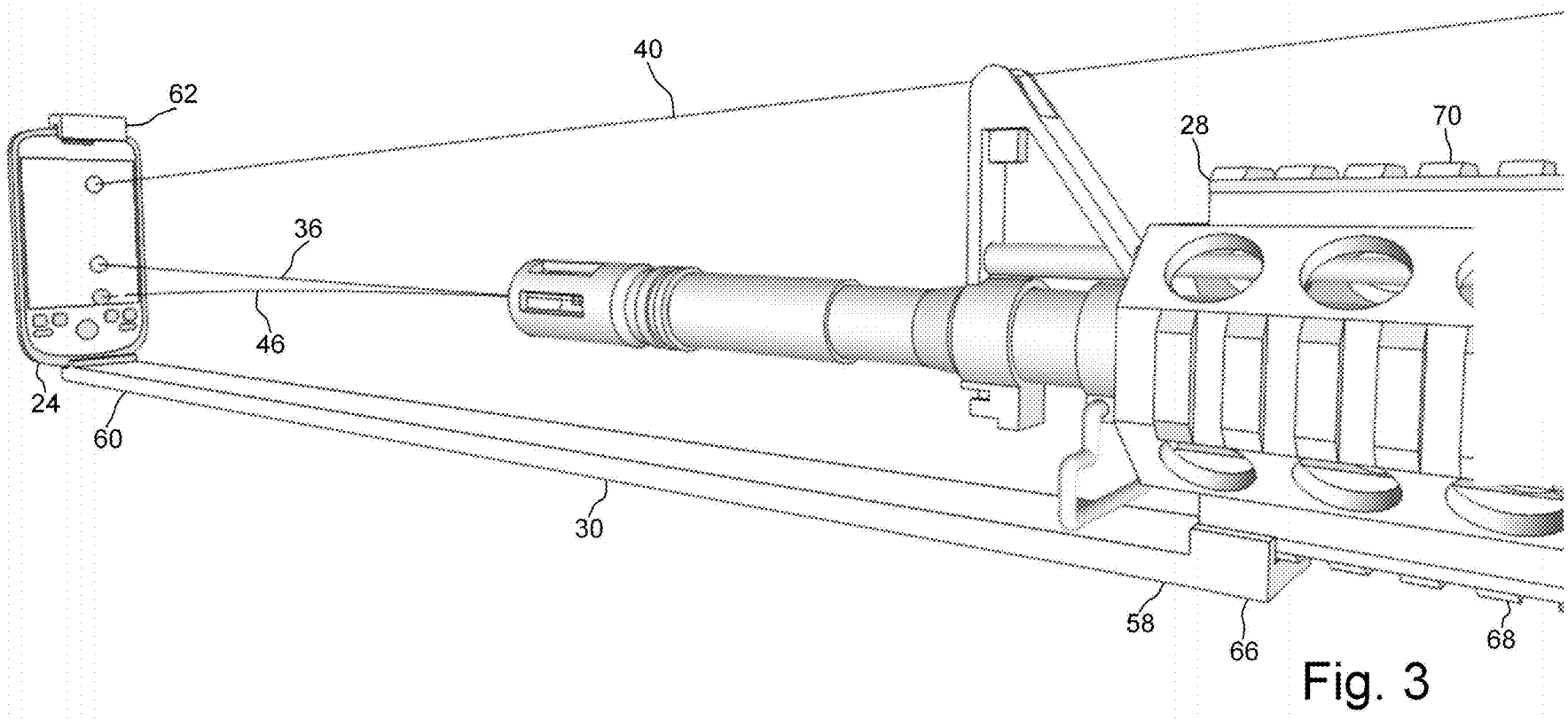
FIG. 3 is a perspective view of the example shown in FIG. 1 where the display device is attached to the firearm in a different manner.

The (positionable) arm 30 as seen best in the examples of FIGS. 2 and 3 has a first end 58 which is attached to the muzzle end 88 of the firearm 28 and a second end 60 having a display device bracket 62 thereon. The embodiment of FIG. 2 includes a barrel attachment clamp 64 which removably attaches directly to the barrel 90 of the firearm 28. The embodiment of FIG. 3 includes a Picatinny rail attachment clamp 66 which attaches to a Picatinny rail 68 portion of a hand guard 70 or similar portion of the firearm 28. The positionable arm 30 in one form is made of a malleable material or a series of movable joints such that the first end 58 is positionable relative to the second end 60. In this way, the placement of the display device 24 can be more easily adjusted as desired relative to an emission beam 36 and/or sight line 40.

Operational Step 1. In operation, the firearm 28 in one form having a chamber insert 74 is actuated, and the bore alignment point 34 (FIG. 4) will be visible to the user, and the point of impact of the emission beam 36 is viewable on the graphic display 26. It may be desired to align the bore alignment point 34 on a specific portion of the graphic display 26; such that the calculated point of impact 32 of a live fire projectile 106 can be determined relative to the point of aim 38. The point of aim 38 is that point viewed by the marksman when the sights 92 of the firearm 28 are aligned. In FIG. 1 for example, a sight alignment line 40 is shown as an extension of the line between the rear sight 42 and front sight 44.

Figure 7:
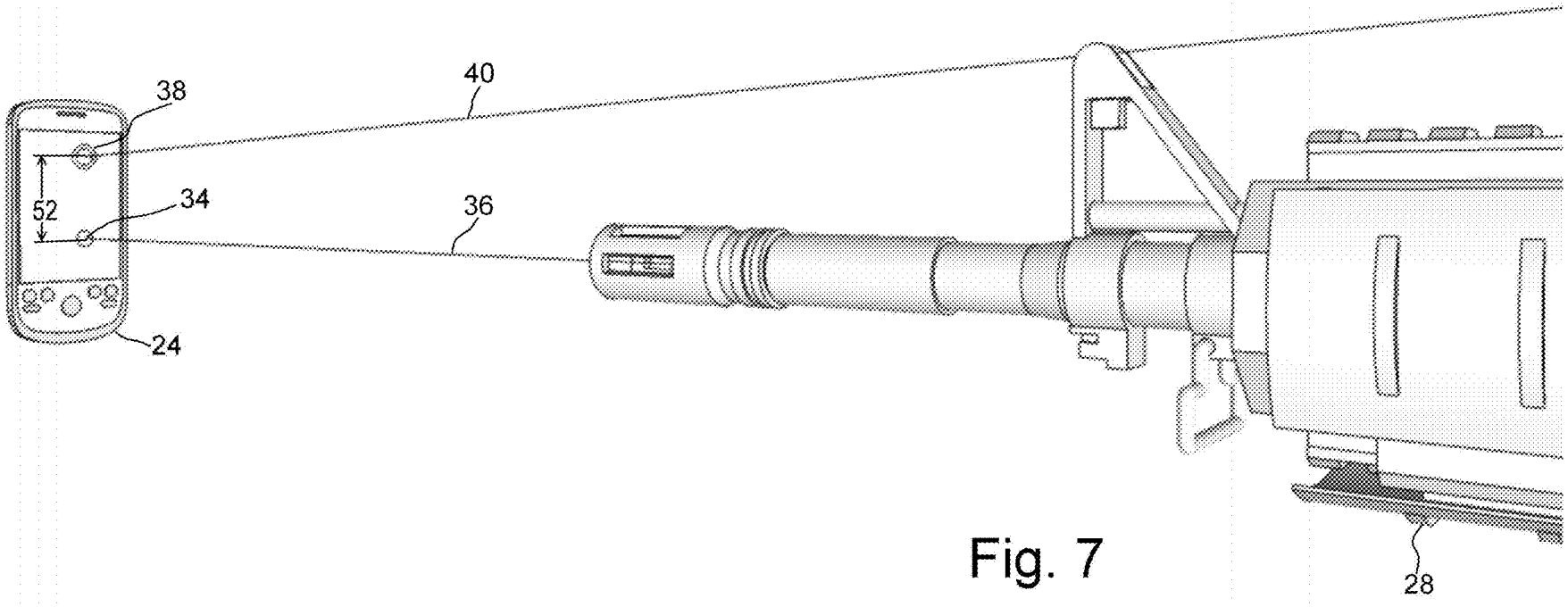
FIG. 7 is a perspective view of the example shown in FIG. 1 wherein the firearm is properly zeroed.

The system 20 is equally useful for open sights (FIG. 1), optical (scope) sights (FIG. 8), laser sights, and other optical and non-optical alignment systems (sights). In each application, the point of aim 38 will be clearly indicated to the user familiar with the sight profile of that firearm. The sight alignment line 40 extends forward to the target, and it is desired for a proper zero that given the conditions at the time of live firing, that the point of impact of a live-fire round aligns with the point of aim 38. Such a properly zeroed assembly is shown in FIG. 7 where the bore alignment line (emission beam 36) is properly positioned relative to the sight alignment line 40. In a simulation as shown in FIG. 4, a proper sight alignment may be achieved when the offset 48 between the point of aim 38 and bore alignment point 34 corresponds to the calculated offset for specified conditions as described above.

Figure 4:
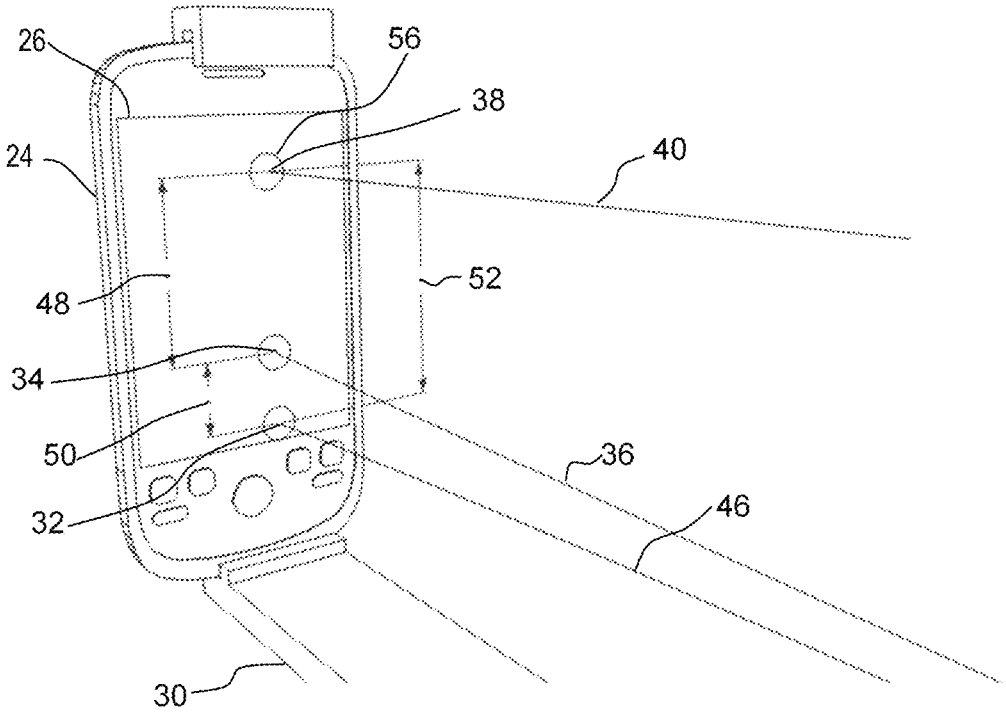
FIG. 4 is a perspective enlarged view of one region of FIG. 1 showing several vertical offsets.
Figure 12:
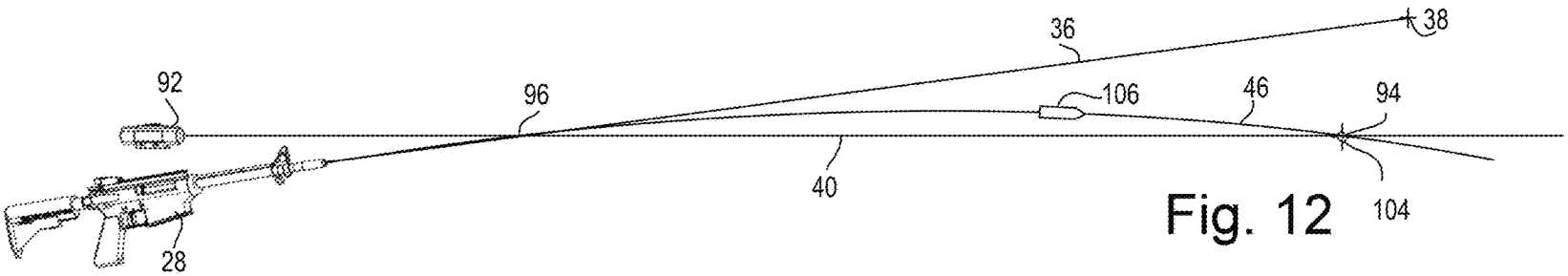
FIG. 12 is a side environmental view one example of a live-fire range in operation with sight and trajectory lines shown not to scale for illustrative purposes.

As shown in FIG. 4 the firearm sights 92 have been adjusted such that the bore alignment point 34 is well below the point of aim 38 and the calculated point of impact 32. If the sights 92 were adjusted to this alignment at a real life firing distance, this alignment would not result in a proper zero given the effects of gravity on a specific life-fire projectile 106 fired at a specified elevation (angle to level), weight, and muzzle velocity. However, in the example shown in FIG. 4, the display device 24 is much closer to the muzzle end 88 of the firearm 28 than a real-life target 104 would normally be. Given a properly zeroed firearm 28, were the sight line 40 extended to the distance 94 of a real-life target 104 as depicted in FIG. 12, the sight line 40 would vertically cross the horizontal plane of the bore alignment line (emission beam 36) at location 96. The downward curvature of the trajectory 46 is shown magnified in the Figs. for ease in description. As previously mentioned, one example of the display device 24 will display calculated points of impact 32 of the projectile on the graphic display 26.

In one example of the UMTS, the marksman will be able to see a graphical representation of the trajectory 46 of the projectile 106 (if so desired) on another screen presentation on the graphic display 26 relative to the bore alignment line (emission beam 36) and/or sight line 40.

If all known conditions and variables are known based on the zero then the ballistics data, the known firing conditions and other variables can be isolated and the results will show the center bore (emission beam 36) and the ballistic characteristic of the firearm 28 and the sight alignment line 40 aligned at the distance 94 the firearm 28 was zeroed.

The display device 24 in one form as shown in FIG. 4 displays to the marksman a sight target 56, which presents to the user a position relative to the bore alignment point 34 from which to zero the firearm in a simulation. When the display device 24 has been configured to the conditions and target desired, the sight target 56 is displayed, and the marksman will align the sights with the sight target 56.

In FIG. 4 a first vertical offset 48 is defined between the center of the sight target 56 and the center of the bore alignment point 34. A second vertical offset 50 is shown between the bore alignment point 34 and the calculated point of impact 32. A combined vertical offset 52 is shown as the combined vertical offsets 34 and 50. The first offset 48 will vary dependent on variables such as distance from the firearm 28 to the display device 24, simulated distance to virtual target, projected ambient temperature, humidity, ballistics of the cartridge to be fired, and ballistics of the firearm 28 used. This UMTS system in one example allows the marksman to adjust the elevation (vertical angle to the bore)

of the sights 92 properly without firing a live round and re-zero their firearm to specific conditions.

Figure 5:
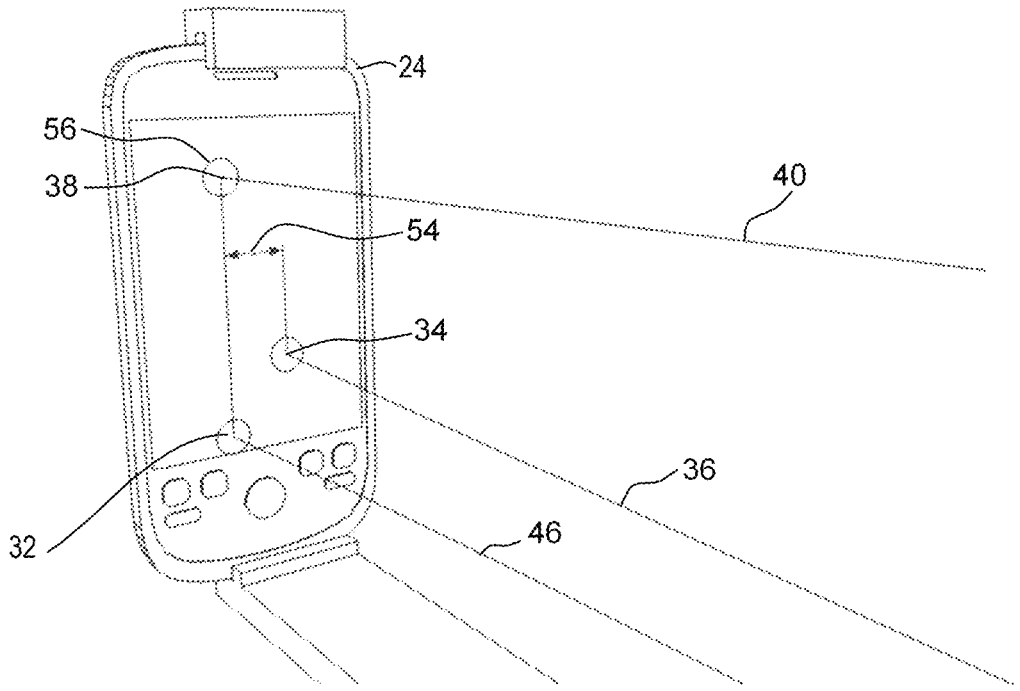
FIG. 5 is a perspective close-up view of the example of FIG. 1 showing a horizontal offset.
Figure 6:
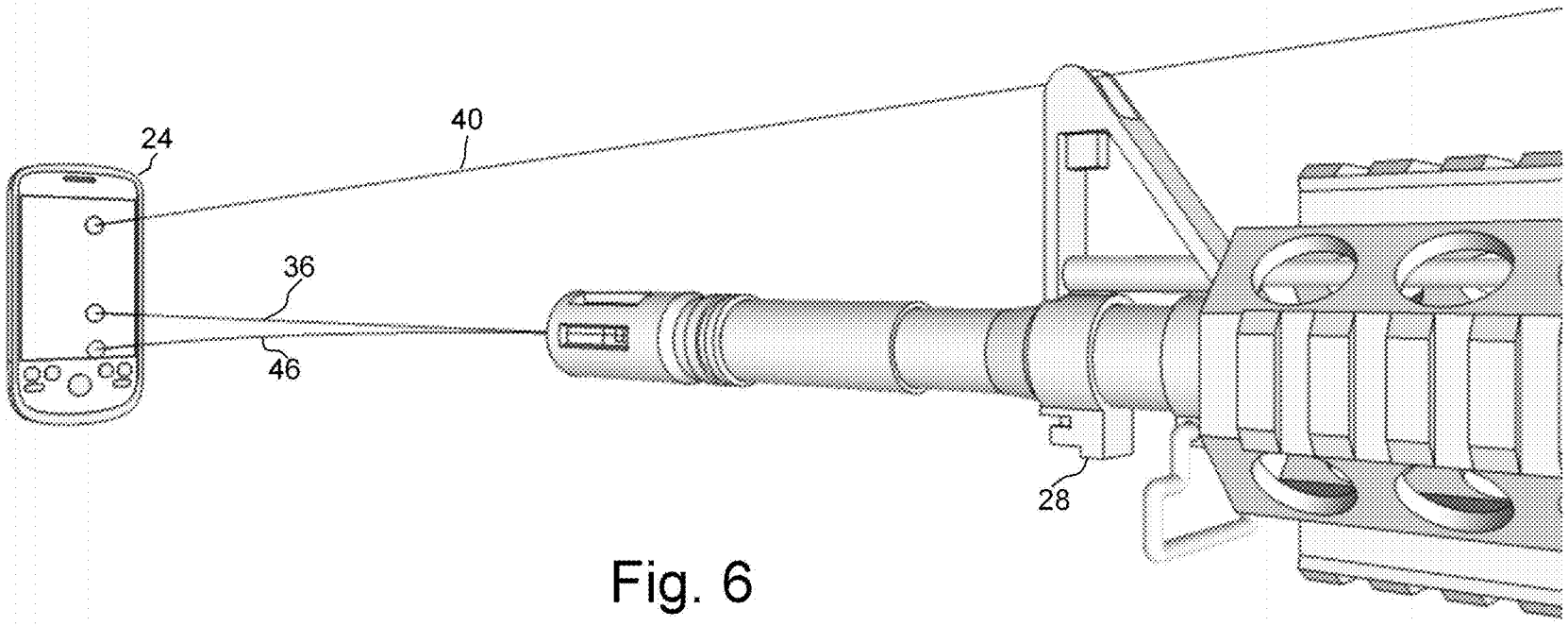
FIG. 6 is a perspective view of the example shown in FIG. 1 wherein the display device is not directly attached to the firearm.

In FIG. 5, a horizontal offset 54 is shown between the sight target 56 and the bore alignment point 34. This offset 54 is presented to account for any horizontal drift due to cross windage, etc. as determined by the variables input into the display device. Generally this offset is used when a particular shot is to be made, and these horizontal effecting conditions are known or can be projected with some certainty.

Given a properly zeroed firearm 28, a marksman will be able to incorporate prior data from previous firing session(s) and utilize the display App in combination with data from any previous live-fire session(s) in a virtual scenario. The display device 24 may present on the graphic display 26 the calculated point of impact 32, and sight target 56 utilizing the input variables (conditions such as weather, location, ballistic data and muzzle velocity, etc.) Should the marksman have any circumstance that they suspect may have adjusted the sights 92 out of alignment, the marksman can verify and realign their sights 92 using the calculated point of impact 32 without expending additional live rounds (projectiles 106).

In one embodiment, the marksman will be able to see the trajectory of the simulated projectile 106 (if so desired) on the graphic display 26 in a different display mode (such as that shown in the example of FIG. 12). If the projectile effecting conditions and variables are known, then the bore data and the known conditions and other variables can be isolated.

Step 2. The marksman can change any variable in the Display App based on conditions (anticipated and/or known) and the display App will account for the change by adjusting the position of the sight target 56 on the graphic display 26. The marksman can change the variables in one example by changing the setting in the Display App, engaging the display device 24, and adjusting the sights 92 of the firearm 28. The display App may in one form present the effect of changing each variable and display the calculated point of impact 32 and/or sight target 56 on the graphic display 26. The variables effecting every shot (projectile 106) can and will change from day to day, location to location, etc. The UMTS allows the marksman to take into account multiple variables affecting the shooting of the firearm 28, and allows the marksman to adjust the sights 92 of the firearm 28 against a virtual target (such as the sight target 56) which represents a real life target 104, and then successfully fire a live round at the real-life target without re-adjusting the sights 92 of the firearm 28.

Step 3. The military is considering issuing their marksmen smart phones or similar display/computing devices 24 for reasons not directly connected to marksman accuracy. The Display App disclosed above could be made a part of an armed forces training platform, so that the teaching and training of the UMTS is conducted with online (internet or intranet connectivity) and may be intuitive to the marksman as a requirement before training with a live-fire firearm 28.

For example, marksmen being deployed to a field posting such as for example Afghanistan may be provided a Display App that simulates targets and conditions commonly found at that field posting. The UMTS 20 could account for the most common elevation and weather conditions present. The Display App could even display a simulated three-dimensional version of the target wherein the display device 24 is coupled to an accelerometer, gyroscope, magnetometer, or other position sending devices, such that movement of the firearm 28, arm 30, and display device 24, move as a unit to present to the marksman a moving environmental display of the target and surrounding environment. As the marksman pans the firearm 28 to the left for example, the display could pan to the right, maintaining the illusion of a real-life target. Adjustments to the offsets 48-54 could also be displayed in real-time as the user elevates the firearm 28, or for example as the relative angle to expected windage varies.

Step 4. The Display App may gather inputs from low cost to no cost data to provide a first layer software data analysis. This first layer data analysis may be appended with a second layer of proprietary software (Computation App) which combines the first layer software in combination with a chamber insert 74 or equivalent beam emitter. In one example, the Display App and the Computation App are one and the same.

Training. In one example, a marksman's live fire zero of the firearm zero sets the base line from where all additional variables can be measured. The chamber insert 74 in one form provides a method to virtually zero the firearm 28 and take into account multiple conditions as stated previously.

In one example, the UMTS 20 may be presented as an interactive training game, such that the marksman can verify the zero while simultaneously being entertained by the UMTS. With his zero set, the marksman can determine the effecting variables to subsequent shots, and account for these variables prior to firing live rounds through the firearm 28. Such variables can be determined from GPS data, weather, and ballistics characteristics of the particular round (cartridge) to be fired, etc.

Savings. The UMTS in several embodiments is particularly beneficial in saving money in wear of the barrel 90 and ammunition expenditure. The firearm 28 will not have to fire any rounds when adjusting the sights 92 to a new firing situation/target and the marksman may need only to verify their zero or determine new muzzle velocity reading based on particular cartridge ballistics.

Education on Ballistics. Due to the engagement of the marksman in the factors that impact the trajectory 46 of a projectile 106 and the impact location of the projectile 106 on the target 104, the marksman is repeatedly exposed to ballistics variables. Constant feedback may be provided to the marksman every time the conditions are changed.

The UMTS in one form may determine what the parts are to the whole of the ballistic equation. The ballistics characteristics of the firearm 28 itself, the location of the shot, and the experience and skill of the marksman, each play a part in accurate firing of the firearm 28. These variables can be isolated and can be input into the Display App to assist the marksman in zeroing their firearm 28 correctly. There are also variables which cannot be accounted for such as human error in an individual shot, and hardware discrepancies such as manufacturer tolerances of an individual cartridge, powder shift within an individual casing, weapon fouling, etc.

In one example of use, a marksman will fire the firearm 28 using live rounds to gain a basic comprehension of shooting. A trainer may then further the marksman in basic marksmanship and with repetition the marksman's abilities will improve. The marksman may then proceed to some type of recorded live firing to measure their performance with the firearm 28. Where possible, the firearm and ammunition performance could be captured and recorded. The weather (windage, rain, barometer, etc.) at the time of recorded live firing could also be measured and accounted for. The location (elevation above sea level, temperature, weather, etc.) of the live fire range could be accounted for such that the effects on the projectile 106 (bullet) as the projectile 106 moves to the target 104 can be isolated and accounted for.

How the marksman applies their experience/training and the mistakes (errors) they make may be captured and also accounted for. Other non-human variables such as imprecise measurement of the earth's movement (rotation) and weather effects, and the inherent errors such as tolerances in firearm and ammunition production that contribute to probable errors in distance and direction may also be calculated and accounted for. As the marksman gains more experience, the human errors should become less significant and become acceptable as the probable error in distance and direction provide a measurement of assurance within the skill of an expert marksman.

Most marksman adjust the sights 92 of their firearm 28 to align with the impact of the projectile 106 on the target 104 at a specific average distance 94. As previously discussed, this process is commonly termed as "zeroing" or "sighting" the firearm 28. As previously discussed, to zero is defined as accounting for the factors that offset the point of impact 32 from the point of aim 38. Sights 92 can be adjusted left, right, up or down as desired/required to adjust the point of aim 38 relative to the point of impact 32 on the target. The marksman may also utilize a chronograph or equivalent apparatus to determine the muzzle velocity of the firearm 28 and life-fire cartridge. By recording live fire results with each marksman, gains in the effectiveness of the marksman could be recorded and supported by specific instruction. The beginning marksman would be introduced to the shooting fundamentals and trained on the UMTS, and the variables that can be accounted for before a beginning marksman proceeds to a life-fire range would be incorporated in their initial adjustments of the weapon sights 92. Later as the marksman becomes more skilled/proficient, the intuitive nature of the shooting process would further improve the effectiveness of the process.

The start of the software application (App).

Situation 1. In one example, once the firearm 28 has been zeroed such as in a live-fire practice environment, the components needed to make the UMTS function as intended include: the chamber insert 74 or equivalent beam emission device, the display device 24, the firearm 28, an optional display device bracket 62, and the display App. One such display device holding bracket is shown in U.S. patent application Ser. No. 11/107,441 incorporated herein by reference. The chamber insert 74 can provide the emission (laser) beam 36 from inside the bore 84 when the trigger 86 is actuated, and may also reset the trigger 86 so that the firearm 28 does not have to be manually reset. Without such a resetting apparatus, the trigger 86 and firing mechanism may need to be manually reset such as by pulling a charging handle 98. When the trigger 28 is actuated the emission beam 36 projects down the barrel 90 and in one example is received by a receiving component 100 at the muzzle end 88 of the barrel 90, or is perceived as it reflects off a target, such as the graphic display 26.

The receiving component 100 in one example is connected to the display device 24 in one form by a data wire 102 used by the display device. Components 100*a* and 100*b* are examples of the component 100. Once the display device is engaged (turned on), connected to any peripherals or power supply, and the Display App in one example is configured to receive data (such as bore alignment point 34) from the chamber insert 74. The chamber insert 74 is centered in the bore 84 of the firearm 28, and is normally configured to standard tolerances of the ammunition case such that when the emission beam 36 or is actuated, the emission beam 36 traverses the length of the bore 84, exits the barrel 90 of the firearm 28, and will impact the display device 24 if the display device 24 is properly positioned. After the emission beam 36 is activated the Display App will register the location of the bore alignment point on the display device 24. The Display App in one example will present the bore alignment point 34 on a target with a gird that shows four squares for example. The distance 94 between a live-fire target 104 and the firearm 28 in one example may vary from 25 to 1000 yards or more although the distance between the firearm 28 and the display device 24 will normally be much less. In one form the distance from the muzzle end 88 of the firearm 28 to the display device 24 will be on the order of 6 to 36 inches. The sight target 56 and the sights (iron sights, scope, or red dot) will generally be at the same vertical height (offset 48) above the bore 84 of the firearm 28. This will be done by controls in the Display App that present the sight target 56 relative to the bore alignment point 34. Once the center of the sight target 56 is aligned with the point of aim 38, then the zero of the firearm is established and can be recorded. In one form the virtual sight target 56 is viewed at a simulated distance.

Situation 2. If the firearm 28 was not previously zeroed then the sights 92 may be adjusted relative to the bore alignment point 34. This will align the point of aim 38 relative to the bore alignment point 34.

The software component (Display App) of the Universal Marksmanship Training System 20 in one form incorporates integrator software or programmed hardware that ties layers of applications to produce an alternate, cost efficient method to maintain a firearm and a marksman from having to overly fire their firearm after the sights and firearm's bore alignment point are aligned (zeroed). The term software will be used herein relative to both software and programmed hardware for ease in description of the disclosure. The integrator software also may be configured as an application (app) in a display device 24 such as a smart phone, ITouch, IPad, IPhone, laptop or desk top computer having a graphic display 26. The term "graphic display" will be used herein to refer to the display portion of all such display devices 24.

The integrator software provides a properly positioned sight target 56 by taking into account the conditions (weather, location, weapon/ammo performance, ballistic computation, etc.) that affect the trajectory of a live-fire bulletin flight from the firearm 28 to a target distance 94. Such conditions may be provided by the user (shooter) or may include global mapping data, weather data, etc. The integrator software in one example takes into account the known conditions to isolate the calculated trajectory 46 of the projectile 106 that can be attributed to the marksman, (training, climate effect, steadying hold factors, and state of mind) and that are difficult to quantify. These conditions will be termed "residuals". The equation of the bullet flight is a combination of weather (W)+location (L)+weapon/ammo performance (A)+ballistics computations (B)+residual (R). In one form, the integrator software is coded into the Display App and/or Commutation App As previously defined, a marksman having aligned the sights 92 with the firearm's projectile point of impact with a particular set of conditions (W,L,A,B) is said to have zeroed the firearm 28. Given that the known conditions (W,L,A,B) when the firearm 28 was zeroed cannot be replicated, the conditions can be accounted for and the residual can be added to a new set (N) of known conditions. The deviation from the previous zero to the new zero would be the tolerance in the instruments that measured W, L, A, B and the change in the R getting smaller (more training). So, R+NW+NL+NA+NB=new zero.

In order to determine R, the Integrator (I) software may incorporate data from (1) weather station type software that can measure real time conditions (2) GPS type software/hardware that can determine latitude, longitude, and or elevation to calculate the effects on the trajectory 46 (3) firearm type and ammunition data software (ballistics tables) that can be used for calculation and for storing (cumulative) inputs based on the same ammunition lot. A chronograph may be used to measure the velocity of the projectile 106 (bullet) to determine the performance of the weapon/ammo combination. Finally (4) ballistics software or ballistic lab may be utilized for interior and exterior ballistic computation.

The marksman at a firing range may conduct the firing of live rounds to align the sights 92 with point of impact (zero) in a standard live firing manner. One exception may be to additionally fire live rounds through a chronograph to determine muzzle velocity of the projectiles 106. After the alignment of the sights 92 and the impact of the projectiles coincide at a particular set of conditions (distance etc.), the marksman has zeroed the firearm 28 to those conditions. Once zeroed, more live rounds may be fired to measure reliability of the firearm 28 and the ammunition. Sufficient live rounds may be fired until the marksman is consistently able to place the live fire rounds within the limits of a dispersion pattern (group) on the target 104. Once the marksman fires an acceptable group, the firing conditions and other data such as sight alignment may be recorded. At this point the chronograph may (again) be used to measure the performance of the firearm and the ammunition.

The UMTS in one form may be configured to integrate into the currently provided simulators or may alternatively stand alone and deliver a zero based on the best available data or an accurate predicted zero with a residual determined from a prior live firing. For a given scenario that involves an engagement with an opposing force, experience with a properly zeroed firearm 28, trained marksmen, and rehearsed TTPs would in a virtual simulation be expected to generally provide a higher survival rate in a live fire combat situation. One key to improved performance is then is accurate marksmen with practiced TTPS. The UMTS provides a way to achieve accurate marksmanship with prediction and simulation and fewer life fired rounds.

The requirements for predicting an accurate zero in one example would be (1) marksman's location, (2) distance 94 to the target 106, (3) known and recording of weather conditions, (5) firearm and ammunition performance and (6) a system of analyzing and assigning a value to each of these conditions. These conditions may be accounted for in the screen presented to the marksman on the graphic display 26 and may be simulations of are real-life presentations virtually displayed during the zeroing or simulated firing of the firearm 28.

Note that the system 20 in one example may be provided in two parts. The first part may be a Display App that can run on smart phones or equivalent display devices 24, and the second part would be a computer program (Computation App) that may operate on a desktop, tablet, or laptop computer remote of the display device 24. In another example, the Computation App is incorporated into the Display App. The Display App may incorporate data provided by the user or a database that provides for example weather and GPS locating data and apply those conditions to the residual. The Display App would then determine the effects from the inputs on the trajectory and add these non-standard conditions to the residual and determine the deviation for a new predicted zero. The predicted zero sight target 56 would be properly displayed on the graphic display 26 that in one example may be attached to the weapon as shown in FIG. 1, 2 or 3.

The Computation App could compute any deviation from the center bore line (emission beam 36) as measured from the emitter 76. In one example, the emitter 76 is actuated every time the trigger 86 is actuated. One example of the hardware that accomplishes this computation is described in more detail below.

The methods used to isolate the conditions that would affect the trajectory 46 of small arm projectiles fired from a firearm 28 may be gathered from portable weather stations and chronographs. The computations of the ballistic solution as the projectile 106 is fired may be provided by the small arm ballistics software application. Such software applications output calculations based on the specifics of the firearm caliber and the characteristics in live round trajectory 46 may serve as input to the UMTS. The marksman would have zeroed his firearm when the point of aim 38 is aligned with the point of impact either at a live fire target distance 94, or at a calculated point of impact 32.

One novel feature of this UMTS is the interaction/connection that the UMTS 20 provides between hardware and software that allows a marksman to use his firearm 28 as the input device for point of aim 38 and center of bore alignment (emission beam 36). The bore alignment point 34 that is projected by the chamber insert 74 may be recorded by the app or the software application.

To minimize the effects of manufactured tolerances (MT) the UMTS in one example would set a reference point based on industry processes on given products that are used to determine the output of the UMTS. The tolerances of a given piece of equipment are known. Standards could be established on MT and this reference point is the departure point for wear and factors assigned to the wear that would account for a these effects on the age/wear/tear on the equipment.

Another novel feature is the utilization of the graphic display 26 on a display device 24. No system available so connects the marksman, their firearm and non standard conditions in a graphic display 26 that can be used with a game engine and mapping software that allows a virtual fly over of the area to be simulated. The graphic display 26 in one example may display the point of aim 38, calculated point of impact, and with a gaming engine and the use of a mapping program the display device 24 could allow the marksman to virtually engage an opposing force on actual ground such as a trail, road or route for a combat patrol. The gaming sub-system would take outputs from various programs to determine a zero from the best available data on known conditions.

The UMTS would take into account that a zero at Fort Benning, Ga. or Fort Drum is different than a zero in Nuristan or Kandahar Afghanistan.

The additional novel component of the UMTS concept is the incorporation of a laser self-guided bullet. The Sandia National Lab has recently announced the creation of such a self-guided bullet. In the news release Scandia mentions that the projectile has an optic sensor to detect a laser beam that will guide the bullet to the target. Given that we know what a ballistic trajectory looks like and the measurement of the known conditions. Such a bullet would allow long range shooting with more precision than available without such componentry. The actual trajectory 46 and ballistics characteristics of any particular firearm 28 and can use this ballistics/trajectory in future live-fire or simulated shots. Additionally, the ballistics trajectory 46 can be determined in a particular set of conditions, and the ballistics data for that situation can be incorporated into all firearms 28 being fired in that situation. Weather (wind, temp, barometer, etc.), elevation, etc. play a part in such data analysis. As this bullet is developed the feasibility to incorporate into the UMTS data from a real time trajectory 46 become reality.

If the residuals are isolated, then a measurement of the effect of non-standard conditions would provide data to the Display App which would incorporate the residuals to determine a new zero sight setting. For example where a military unit of 100 marksmen has zeroed at a deployment center and has recorded all conditions present when they went to the field. They used 1000 live rounds and the support infrastructure that must be used at the range, such as targets, firearm lubrication, and firearm cleaning material to initially life-fire zero their firearms. When the unit arrives for example in Afghanistan a 0.50 cal projectile formed to give the same ballistic coefficients at the range from 300 to 800 meters as the ammunition they will fire in combat may be fired at an estimated target distance in the environmental conditions present. When firing one of these projectiles, measuring the vertical and horizontal deviation from the point of aim to point of impact would give the total deviation. Subtract the residual of this 0.50 projectile and would provide the true real time deviation from non standard conditions that would be added to every firearm 28 to derive a new accurate predicted zero from the live fire zero at a deployment center to the field in Afghanistan. This could be done in conjunction with a life-fire range firing to show leaders and their subordinates how close the zero established virtually from the data is to actual live-fire results. This would instill confidence in the effectiveness of such a self-guided bullet.

In this scenario the savings of the disclosed UMTS would be substantial. To calculate the savings one must consider all that would go into planning and resourcing equivalent live-fire training in a combat zone. The UMTS based on the laser self guided projectile could then become even more cost effective.

Another factor to consider in the use of the UMTS is a gaming/entertainment aspect. Today's youth are generally more adept at and interested in virtual systems and gaming than any other previous generation. Simulation could be incorporated as an important part of training to acquire the skills that create muscle and cognitive memory for the engagement of opposing forces. UMTS allows the marksman to practice in a virtual environment those skills at many locations, including those where live-fire practice is unsafe or otherwise undesired.

Figure 8:
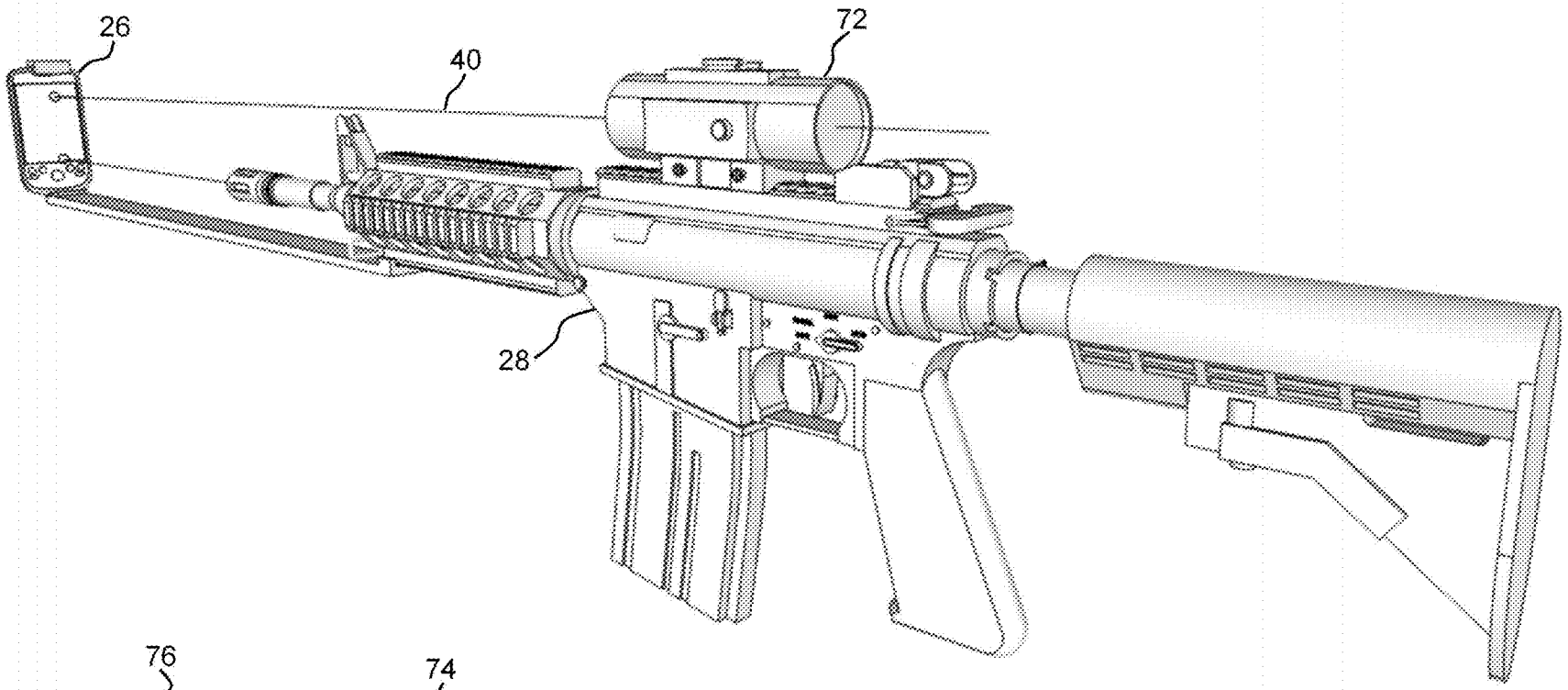
FIG. 8 is a perspective view of an example of the disclosed apparatus employing another embodiment of a sight.

While the embodiments shown in FIGS. 1-7 show use of the UMTS 20 with iron sights 92, the embodiment shown in FIG. 8 discloses the use of an optical sight 72. The sight shown is a common "red dot" sight, but other closed, optical, and or telescopic sights can be used.

Figure 10:
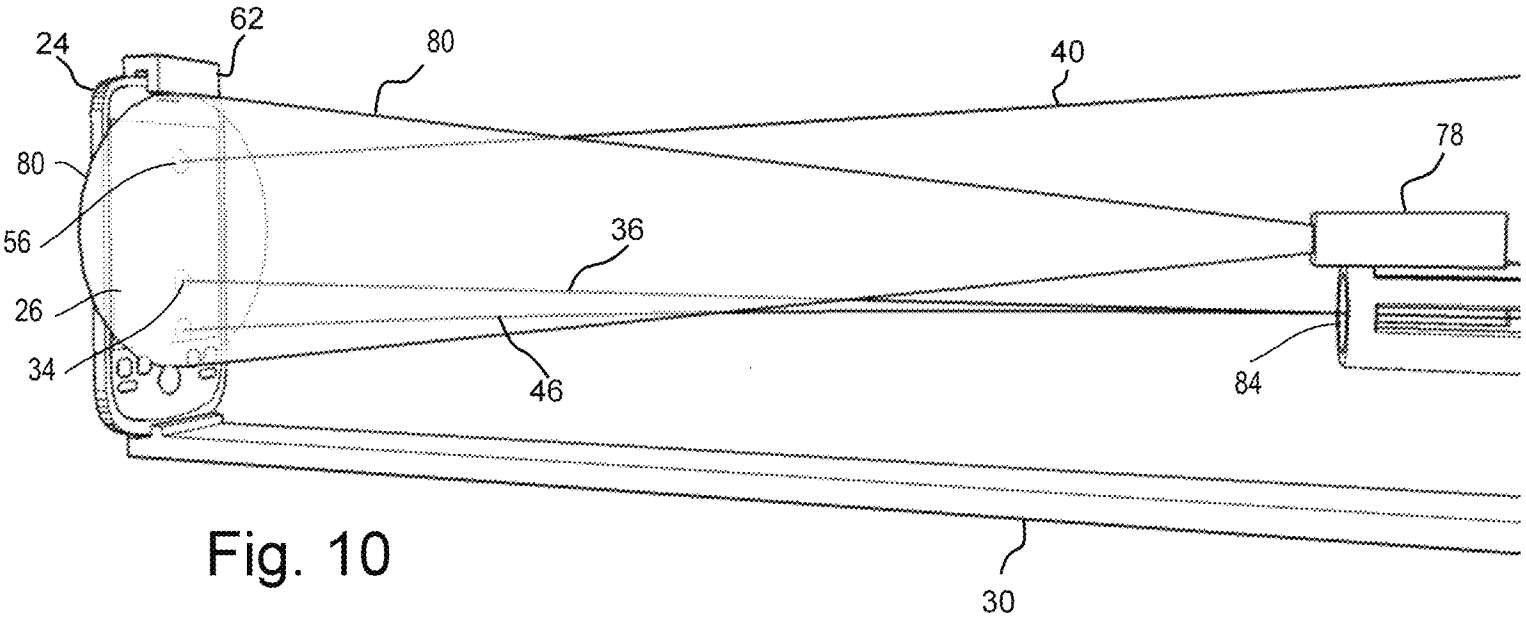
FIG. 10 is a perspective view of one example of the disclosed system showing the detection zone of a sensor.

In one form as shown in FIG. 10, the UMTS 20 utilizes motion plus or 3D motion tracking technology (sensor) 78 that will allow the marksman to locate the position of the display device 24 and/or track the firearm's position in relationship to the sight target 56 presented on the graphic display provided that the display device is within the sensor's field of view 80.

In one form, the sensor 78 will detect the location of the bore alignment point 34 as the bore line (emission beam 36) from the chamber insert impact the display device 24 at point 34. The display device 24 may display to the marksman the location of the sight target 56 and/or bore alignment point 34 on the graphic display.

Figure 11:
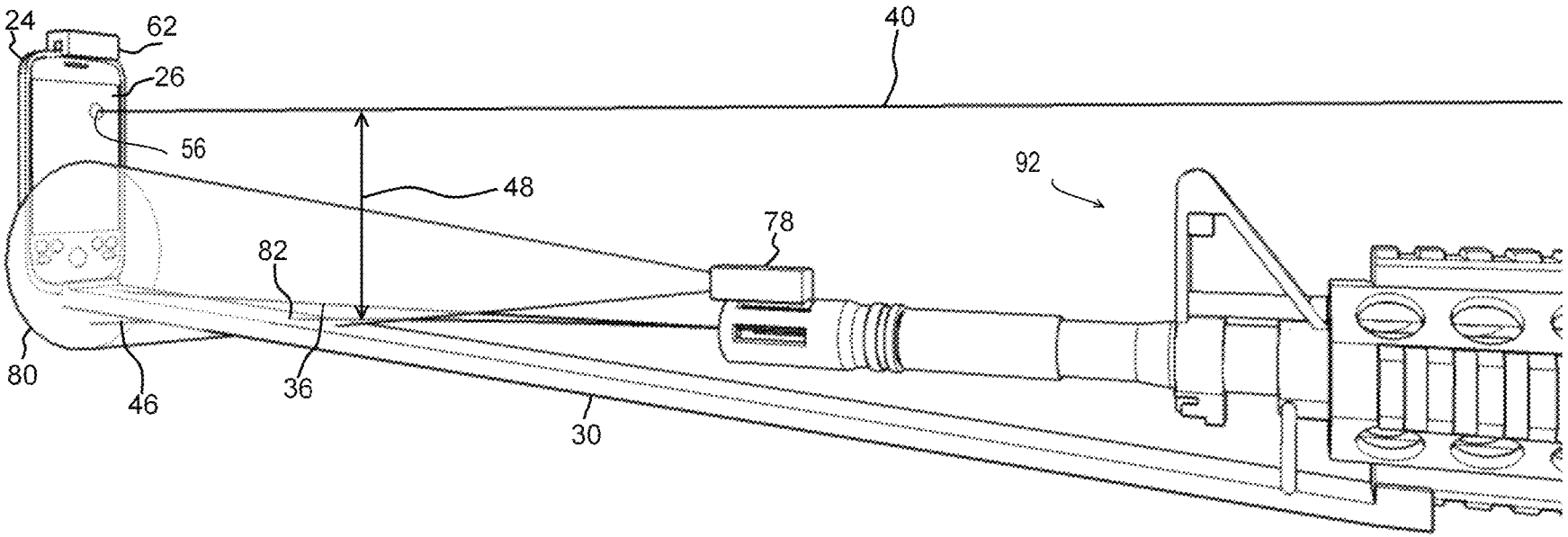
FIG. 11 is another perspective view of one example of the disclosed system as shown in FIG. 3 and further showing a sensor.

In the configuration shown in FIG. 11, the emission beam 36 and the simulated trajectory 46 do not intersect with the graphic display 26. In some applications, where the vertical offset 48 between the sight line 40 and bore line (emission beam 36) is greater than the widest (tallest) dimension of the graphic display 26 or the display device 24, the emission beam 36 and/or the simulated trajectory 46 may not intersect with the graphic display 26 or the display device 24. In the embodiment shown in FIG. 11, it can be seen how the emission beam 36 impacts the positionable arm 30 generally at location 82. The sensor 78 may detect the emission beam 36, the point of intersection 82, or may be independent of the emission line altogether. Where an optic sight 92 such as a scope is used high above the bore 84 of the firearm 28, such a large vertical offset is not uncommon. Attachment systems such as the Picatinny system shown may exacerbate the offset distance 48.

In such an application the use of a sensor 78 is especially helpful, provided that at least an identifying part of the apparatus can be detected by the sensor 78. In FIG. 11 for example, at least the lower portion of the display device 24 is within the field of view 80 of the sensor 78. As such, the sensor will detect the position and orientation of the display device 24, and be able to properly and accurately provide a sight target 56 to the shooter.

In one form, the sensor 78 may take the place of the chamber insert 74, and may be placed in, around, or on the barrel 90 or bore of the firearm 28 using connection configurations utilized in components 100*a* which fits (partially) into to muzzle end 88 of the bore 84 or component 100*b* which is threaded onto the muzzle end 88 of the bore 84.

Connectivity between the display device 24 and the chamber insert may be established by a hard (data) wire connection 102 or wireless connection such as a Bluetooth Radio, or WiFi connection.

The Display App in one form may establish the distance and relative position/alignment of the chamber (or other portion) of the firearm 28 to the sensor 78 and use this relative position/alignment to project the images, including for example the sight target 56, that is shown on the graphic display 26. In one form, the marksman will visually perceive a target or a target scenario that is visually corrected by the program to portray an actual distance in a simulated environment. The software application in one form will also have the capability to determine corrections for angle (elevation angle) from the sight location to the emission beam 36 at the sensor 78 location. This determination may allow the Display App to correctly display the corresponding sight picture at various distances.

In one example, a remote control device 108 may be utilized to manipulate the Display App and/or the display device 24. The remote device example shown in FIG. 13 may be a wrist device. In some examples, the remote control device 108 is connected wirelessly to the display device 24 such as through WiFi, Bluetooth, radio, infrared (IR), or other connections.

Figure 15:
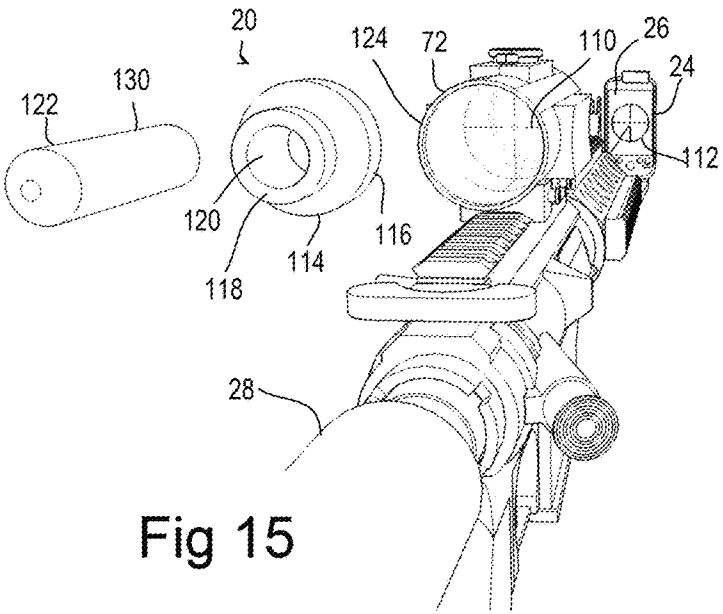
FIG. 15 is a rear isometric enlarged view of the example shown in FIG. 14.

In another example as shown in FIG. 15 hardware and software are provided to display the reticle 110 of the optical sight 72 on the graphic display 26.

The UMTS 20 in this example may require an adapter 114 having a first end 116 that mounts at the eye piece 124 of a firearm sight 72. In this example, centered in the adapter 114 is a version of a display device compatible camera 122. The camera 122 in one example is connected to the display device 24 by data wire 132 or wireless methods. The camera 122 in one example records an image 112 of the reticule 110 and provides the display device 24 with a video signal to the display device 24. The display device 24 would display the image 112 of the reticle 110 on the graphic display 26 and the apparatus in one example would have a way of focusing the image 112 of the reticle 110 on the graphic display 26. The camera in one example is integral to a display/computing device (smart phone). For example, the assembly shown in FIGS. 14 and 15 may alternatively utilize a camera/computing device optically connected to item 130.

In this example, the marksman in not looking through the optical sight 72, instead the marksman is looking at the graphic display 26 of the display device 24 and views what the camera 122 records. The Display App in one example will allow the marksman to reposition images to the displayed reticle 112 and align those displayed images to the displayed reticle 112. This repositioning in one example may be accomplished by moving one image at a time, up, down, left, right and in one example being able to rotate the image of a grid 128 to precisely align with the displayed reticle 112. In one example, the marksman will repeat these steps with three different images that verify the positioning of the last image in sequence. Once this is done the alignment of images is recorded in the Display App providing a visual record of the alignment.

The importance of this recording is apparent when the marksman suspects that his optical sight 72 may have been disturbed and wants to verify and confirm that the point of aim 38 and the impact of projectiles 106 still coincide at specified conditions. The firearm 28 could have fallen, the marksman could have fallen with the firearm 28 or the optical sight 72 may have been removed for some reason and placed back on the firearm 28.

Figure 14:
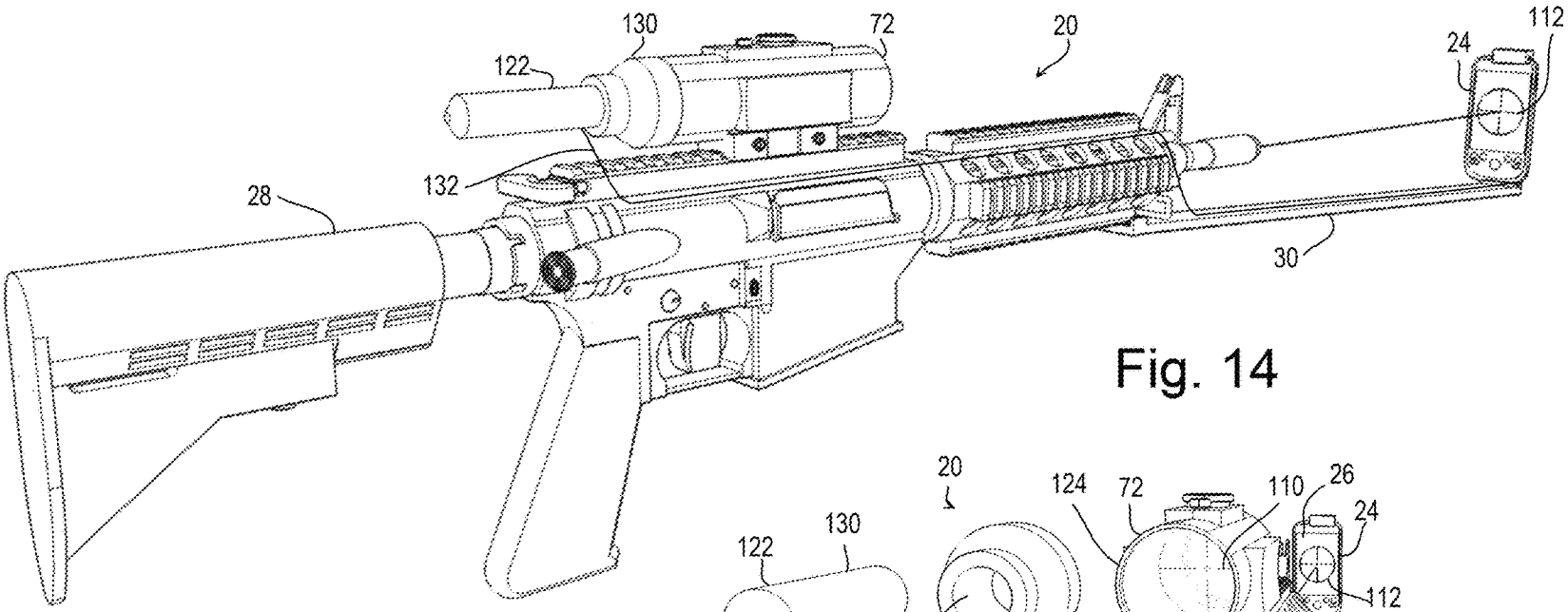
FIG. 14 is a side isometric view of another example of the apparatus utilizing a camera adapted to attach to the sighting apparatus.

To verify the zero of the firearm, the marksman places the apparatus (including for example adapter 130, camera 122, arm 30, and display device 24) in position as shown in FIG. 14. The marksman then turns the Display App on and the Display App will display the reticle 110 of the sight 72 as a displayed reticle 112. In one example, the Display App will instruct the marksman for the procedure of alignment to be followed. The Display App in one example will request if the marksman desires to confirm his zero and will compare the two images (recorded zero image 126 and live image 112 transmitted by camera 122). In one example, the alignment procedure on both images takes out the error of cant and allows the comparison of any change between the images 112/126.

Figure 16:
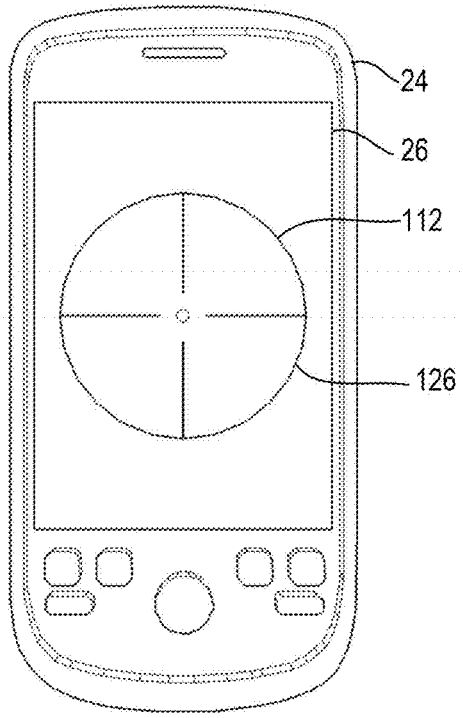
FIG. 16 is a front plan view of the display device with a sight target displayed thereon.
Figure 17:
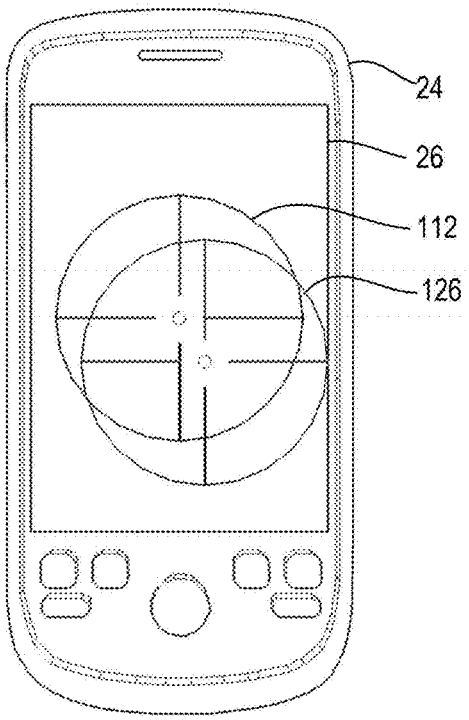
FIG. 17 is a front plan view of the display device with a recorded and live sight target.
Figure 18:
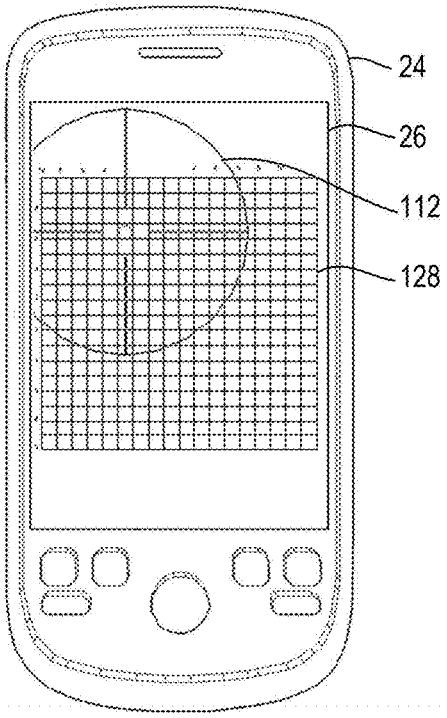
FIG. 18 is a front plan view of the display device showing a recorded sight target and grid improperly aligned.
Figure 19:
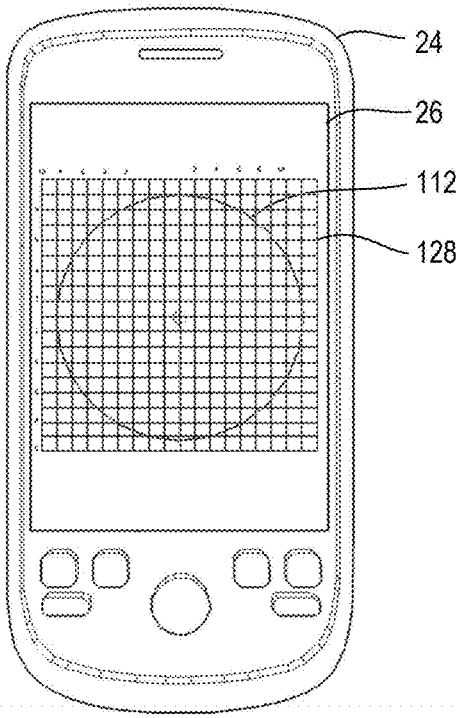
FIG. 19 is a front plan view of the display device showing a recorded sight target and grid properly aligned.

If the recorded and live images 126/112 align, the zero has not moved as is easily seen in FIG. 16 with the live image 112 overlaid on the recorded image 126 of zero. If the recorded and live images 126/112 do not align, the zero has moved as is easily seen in FIG. 17 with the live image 112 overlaid adjacent the recorded image 126 of zero The marksman is then confident that the zero of his firearm has not shifted and can store the apparatus (including for example adapter 130, camera 122, arm 30, and display device 24). If the recorded and live images do not align then the Display App in this example will show how far the live image is from the recorded image on the grid as shown in FIG. 18. A proper grid alignment is shown in FIG. 19. The marksman can either reposition the reticle back to the recorded image by adjusting the sight 72 or may re-zero at a live-fire range. The live-fire re-zero would only be suggested if the marksman did not have confidence in the visual data provided by the Display App.

Through testing and experience gained with this method the marksman would not have to live-fire re-zero and would have confidence in the corrections provided by the UMTS 20.

In one example, where the display device includes a video recording device (camera) on the side opposing the graphic display 26, the Display App may be configured to display the video perceived by the camera to the graphic display 26. In such an example, a sight target 56 may be overlaid upon the video such that the graphic display 26 is effectively invisible as a user views down the sight line 40 of the firearm.

Figure 22:
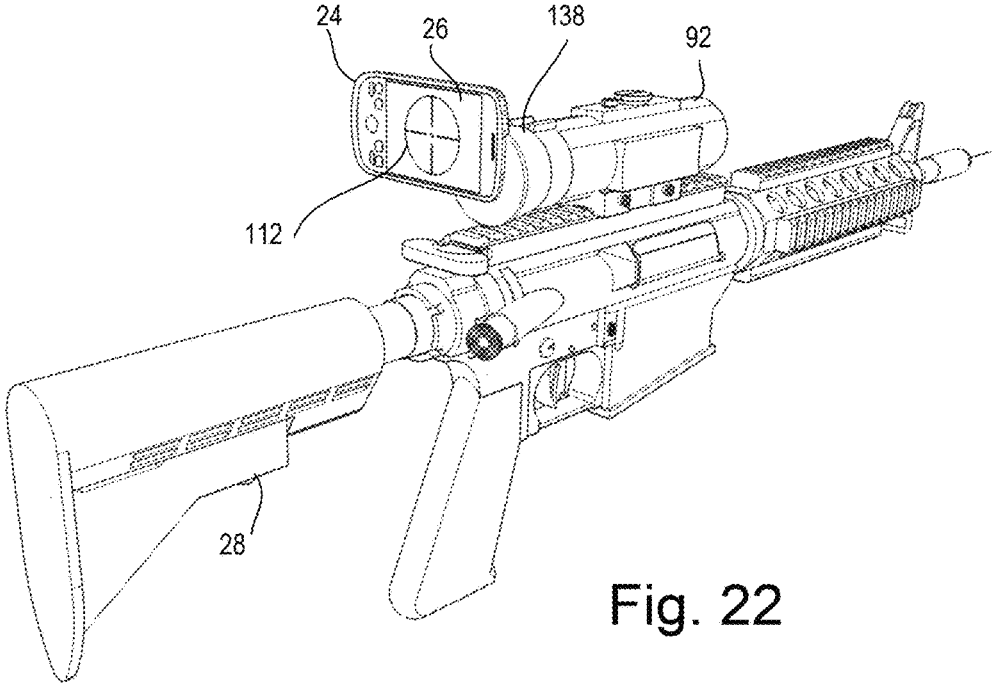
FIG. 22 is a rear isometric view of one example of the apparatus where a display device is adapted to connect to the rear side of a sighting apparatus.
Figure 23:
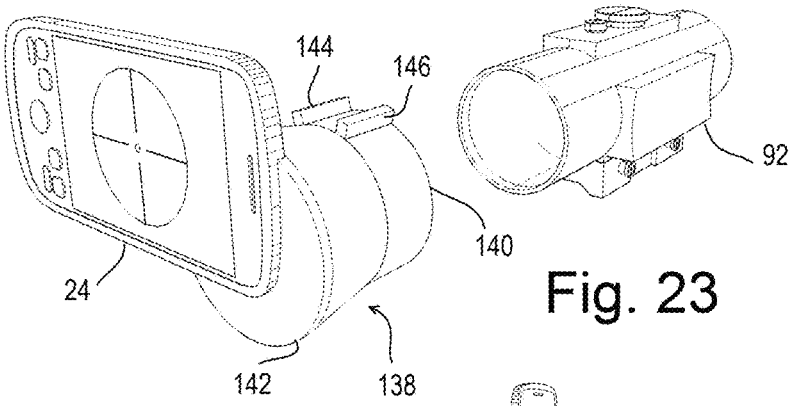
FIG. 23 is an exploded enlarged view of several components shown in FIG. 23.

Another example is shown in FIGS. 22 and 23 which utilize an adapter 138 that mounts on the firearm sight 92. The display device 24 will display the images from the app for the recording of zero that represents the accounting of variables that can affect the trajectory 46 of the projectile 106 (bullet). This sight setting corresponds to the firearm sight setting that results in the point of aim 38 corresponding to the point of impact of the projectile. The app in one example is configured to rotate the displayed reticle 112 and/or an optional grid 128 (FIG. 18) and align the displayed reticle 112 vertically and/or horizontally much like the actuators that are used on a firearm sight 92.

In this example, the adapter 138 has a first end 140 which (removably) attaches to the sight 92 and a second end 142 which removably attaches to a display device 24 such that a user does not view the live image through the sight 92 directly, but rather views a projected image of the reticle 112 upon the graphic display 26. The actual reticle of the sight 92 and sight picture viewed through the sight 92 is received in one example by a camera (video) lens. In the example of FIG. 22, the camera lens is in the bottom right rear portion of the display device 24 and aligned with the radial center (sight line) of the adapter 20 and sight 92.

In FIG. 23, an example of the adapter 138 is shown utilizing an expanding spring clamp 144. In the example shown a plurality of user engagement surfaces 146 are pressed together, and when released the expanding spring clamp 144 engages the surface of the sight 92 to hold the adapter 138 and display device 24 in the correct position.

The base line is the first image and the initial procedure. If the same routine used to set up the record of the sight setting when the firearm was zeroed and then when one desires to check, or generally suspects some adjustment may have affected zero, then the difference can only be the variation from the first image (zero) to the second image (suspect). This may amount to nothing or the shift that indicates the change from the time of the first image to the second image due to whatever condition caused the necessity for the check.

The sensor that may be used in the chamber insert may be one of the following:

An acoustic proximity sensor works on the same principle as sonar. A pulsed signal, having a frequency somewhat above the range of human hearing, is generated by an oscillator. This signal is fed to a transducer that emits ultrasound pulses at various frequencies in a coded sequence. These pulses reflect from nearby objects and are returned to another transducer, which converts the ultrasound back into high-frequency pulses. The return pulses are amplified and sent to the robot controller. The delay between the transmitted and received pulses is timed, and this will give an indication of the distance to the obstruction. The pulse coding prevents errors that might otherwise occur because of confusion between adjacent pulses.

A capacitive proximity sensor uses a radio-frequency (RF) oscillator, a frequency detector, and a metal plate connected into the oscillator circuit. The oscillator may be designed so that a change in the capacitance of the plate, with respect to the environment, causes the frequency to change. This change is sensed by the frequency detector, which sends a signal to the apparatus that controls the robot. In this way, a robot can avoid bumping into things. Objects that conduct electricity to some extent, such as house wiring, animals, cars, or refrigerators, are sensed more easily by capacitive transducers than are things that do not conduct, like wood-frame beds and dry masonry walls.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A universal marksmanship training system for a live fire firearm with sights providing a sight picture when viewed along a sight line, a barrel with a bore there through, the training system comprising:

a display device comprising a graphic display configured to be mounted rearward of the sights of the firearm;

the display device comprising a camera aligned with the sight line;

the camera capturing a visual target image of the sight picture;

a display app;

a chamber insert configured to be positioned with the chamber of the firearm;

wherein the chamber insert interacts with the display app to determine alignment of the bore of the firearm relative to the visual target;

the display app configured to display a vertical offset of the sight line relative to the bore of the firearm;

wherein the display app calculates the vertical offset distance of the sight target relative to the bore alignment point given a set of condition variables; and the display app configured to display the vertical offset of the visual target relative to the bore of the firearm.

2. The training system as recited in claim 1 wherein the condition variables are selected from the list consisting of:

elevation of a live-fire target relative to the firearm;

weather conditions expected at the live-fire target;

ballistic characteristics of the firearm;

ballistics characteristics of a cartridge to be fired;

distance to the live-fire target; and marksman firing offset.

3. The training system as recited in claim 1 further comprising sights selected from the list consisting of open sights, iron sights, closed sights, an optical sight, scope, laser sight, and a red dot sight.

4. The training system as recited in claim 1 wherein the chamber insert comprises a laser device.

5. The training system as recited in claim 4 further comprising a magazine having a power supply electrically coupled to the chamber insert.

* * * * *